US011549085B2

(12) United States Patent
Schmiedel et al.

(10) Patent No.: US 11,549,085 B2
(45) **Date of Patent: *Jan. 10, 2023**

(54) SOLID PERFUME-CONTAINING COMPOSITION

(71) Applicant: Henkel AG & Co. KGaA, Duesseldorf (DE)

(72) Inventors: Peter Schmiedel, Duesseldorf (DE); Danilo Panzica, Hilden (DE); Regina Stehr, Neuss (DE); Dieter Nickel, Pulheim (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/846,506

(22) Filed: Apr. 13, 2020

(65) Prior Publication Data

US 2020/0325424 A1 Oct. 15, 2020

(30) Foreign Application Priority Data

Apr. 12, 2019 (EP) ..... 19168929

(51) Int. Cl.

| | |
|---|---|
| ***C11D 17/00*** | (2006.01) |
| ***C11D 11/00*** | (2006.01) |
| ***C11D 3/08*** | (2006.01) |
| ***C11D 3/20*** | (2006.01) |
| ***C11D 3/37*** | (2006.01) |
| ***C11D 3/50*** | (2006.01) |
| ***C11D 17/06*** | (2006.01) |

(52) U.S. Cl.

CPC ..... *C11D 11/0017* (2013.01); *C11D 3/08* (2013.01); *C11D 3/2079* (2013.01); *C11D 3/373* (2013.01); *C11D 3/50* (2013.01); *C11D 17/06* (2013.01)

(58) Field of Classification Search

CPC ..... C11D 11/0017; C11D 3/50; C11D 3/2075; C11D 17/044; C11D 3/227; C11D 3/2079

See application file for complete search history.

(56) References Cited

U.S. PATENT DOCUMENTS

| | | | | |
|---|---|---|---|---|
| 6,387,861 | B1 * | 5/2002 | Van Asperen ..... | C11D 3/38609 510/298 |
| 2004/0152617 | A1 * | 8/2004 | Murphy ..... | C11D 1/02 510/475 |

FOREIGN PATENT DOCUMENTS

| | | | |
|---|---|---|---|
| DE | 19530999 | A1 | 2/1997 |
| EP | 3476927 | A1 | 5/2019 |
| WO | 2007113326 | A1 | 10/2007 |
| WO | 2018055111 | A1 | 3/2018 |

OTHER PUBLICATIONS

EP Search Report EP 19168929.8 Completed: Oct. 18, 2019; dated Oct. 25, 2019 7 Pages.

Wikipedia. "Magnesiumsulfat". de.wikipedia.org/wiki/Magnesiumsulfat. 5 Pages. Accessed Oct. 17, 2019.

* cited by examiner

*Primary Examiner* — John R Hardee

(74) *Attorney, Agent, or Firm* — Thomas G. Krivulka

(57) ABSTRACT

A solid particulate composition including, based on the total weight of the composition, a) 20 to 95 wt. % of at least one water-soluble carrier material selected from hydrous salts of which the water vapor partial pressure corresponds, at a specific temperature in the range from 30 to 100° C., to the $H_2O$ partial pressure of the saturated solution of salt; b) 0.1 to 20 wt. % fragrance; and c) 0.1 to 30 wt. % of at least one textile-care compound. The invention further relates to the use and a method for the preparation of a solid particulate composition.

20 Claims, No Drawings

SOLID PERFUME-CONTAINING COMPOSITION

FIELD OF THE INVENTION

The present invention relates to a solid, particulate composition comprising at least one water-soluble carrier material, at least one fragrance, and at least one textile-care compound, the carrier material being a hydrous salt (hydrate) of which the water vapor partial pressure, at a specific temperature in the range of from 30 to 100° C., corresponds to the $H_2O$ partial pressure of the saturated solution of said salt, such that the salt melts at this temperature in its own water of crystallization. Furthermore, the invention relates to methods for preparing the solid composition and to a washing or cleaning agent containing the solid composition. Moreover, the present invention also relates to the use of a washing or cleaning agent of this kind for cleaning textiles and corresponding methods for cleaning textiles using a washing or cleaning agent of this kind.

BACKGROUND OF THE INVENTION

When using washing and cleaning agents, the consumer not only aims to wash the objects to be treated, but also wishes that after treatment, for example after washing, the treated objects, such as textiles, have a pleasant smell. For this reason in particular, most commercially available washing and cleaning agents contain fragrances.

Fragrances are often used in the form of fragrance particles, either as an integral component of a washing or cleaning agent, or metered into the washing drum right at the beginning of a wash cycle in a separate form. In this way, the consumer can control the fragrancing of the laundry to be washed by means of individual metering. One product format which enables the separate metering of fragrances is the fragrance pastille.

The main constituent of such fragrance pastilles known in the prior art is typically a water-soluble or at least water-dispersible carrier polymer, such as polyethylene glycol (PEG), which is used as a vehicle for the integrated fragrances and which dissolves more or less completely in the wash liquor during the washing process, so as to release the fragrances contained and optionally other components into the wash liquor. For the preparation of the known fragrance pastilles, a melt is produced from the carrier polymer, which melt contains the remaining ingredients or these are then added, and the resulting melt is then fed to a shaping process, in the course of which it cools, solidifies and assumes the desired shape.

The known products have the disadvantage that the polymer materials used, in particular PEG, have delayed solubility, which can lead to residues on the laundry or in the washing machine, in particular in the case of short wash cycles, low temperature or other unfavorable conditions.

Furthermore, the fragrance pastilles described in the prior art generally have no additional function, i.e. they are generally used exclusively for fragrancing. From the perspective of the consumer, a second or third function is desirable in addition to fragrancing. Textile care is a particularly relevant second function in connection with fragrance pastilles.

BRIEF SUMMARY OF THE INVENTION

The object of the present invention was therefore to identify an alternative composition which exhibits a suitable processing range and at the same time, in the usual temperature ranges in which work is carried out, exhibits improved water solubility and, in addition to the fragrance effect, also has a textile-care effect.

In a first aspect, the application is therefore directed to a solid, particulate composition, comprising, based on the total weight of the composition, a) 20 to 95 wt. % of at least one water-soluble carrier material selected from hydrous salts of which the water vapor partial pressure corresponds, at a specific temperature in the range of from 30 to 100° C., to the $H_2O$ partial pressure of the saturated solution of said salt;

b) 0.1 to 20 wt. % fragrance;

c) 0.1 to 30 wt. % of at least one textile-care compound.

The solid, particulate composition as described herein is prepared from a solution of the carrier material in the water/water of crystallization contained in the composition, where, for such a solution, the term "melt" is also used herein, in contrast to the established use, to denote the state in which the carrier material dissolves by eliminating water in its own water of crystallization and thus forms a liquid. The term "melt" as used herein therefore refers to the liquid state of the composition which results when the temperature at which the carrier material eliminates water of crystallization and then dissolves in the water contained in the composition is exceeded. The invention therefore also relates to the corresponding dispersion containing the herein described (solid) substances dispersed in the melt of the carrier material. Thus, when reference is made below to the solid, particulate composition, the corresponding melt/melt dispersion from which it is obtainable is always included. Since these do not differ in composition except for the state of matter, the terms are used interchangeably herein.

The term "melt body" is used herein to describe the solid particles which can be obtained from the liquid composition upon cooling by solidification/reshaping.

DETAILED DESCRIPTION OF THE INVENTION

The main component of the solid particulate composition as described herein is at least one water-soluble carrier material. In a preferred embodiment, the water-soluble carrier material is contained therein in an amount of from 30 to 95 wt. %, preferably from 40 to 90 wt. %, in particular from 45 to 90 wt. %, based on the total weight of the composition.

The at least one carrier material is characterized in that it is selected from hydrous salts of which the water vapor partial pressure, at a specific temperature in the range of from 30 to 100° C., corresponds to the $H_2O$ partial pressure of the saturated solution of said salt at the same temperature. As a result, the corresponding hydrous salt, also referred to herein as a "hydrate," dissolves upon reaching or exceeding this temperature in its own water of crystallization, thereby transitioning from a solid to a liquid state of matter. Preferably, the carrier materials according to the invention exhibit this behavior at a temperature in the range of from 40 to 90° C., particularly preferably between 50 and 85° C., even more preferably between 55 and 80° C.

In particular, sodium acetate trihydrate ($Na(CH_3COO).3H_2O$), Glauber' s salt ($Na_2SO_4.10H_2O$), trisodium phosphate dodecahydrate ($Na_3PO_4.12H_2O$) and strontium chloride hexahydrate ($SrCl_2.6H_2O$) are included in the previously described water-soluble carrier materials from the group of hydrous salts. The use of sodium acetate trihydrate ($Na(CH_3COO).3H_2O$) is particularly preferred.

In summary, a second aspect of this application results in a solid, particulate composition comprising:

a) 20 to 95 wt. %, based on the total weight of the composition, sodium acetate trihydrate;

b) 0.1 to 20 wt. % fragrance;

c) 0.1 to 30 wt. % of at least one textile-care compound.

If the particulate composition contains sodium acetate trihydrate, compositions which contain the sodium acetate trihydrate in an amount of 30 to 95 wt. %, preferably 40 to 90 wt. %, in particular from 45 to 90 wt. %, based on the total weight of the composition, are particularly advantageous with regard to their manufacturability, packaging and handling.

A particularly suitable carrier material is sodium acetate trihydrate ($Na(CH_3COO).3H_2O$), since it dissolves in the particularly preferred temperature range of from 55 to 80° C., specifically at approximately 58° C., in its own water of crystallization. The sodium acetate trihydrate can be used directly as such, but it is alternatively also possible to use anhydrous sodium acetate in combination with free water, the trihydrate then forming in situ. In such embodiments, the water is used in a substoichiometric or hyperstoichiometric amount, based on the amount required to convert all the sodium acetate to sodium acetate trihydrate, preferably in an amount of at least 60 wt. %, preferably at least 70 wt. %, more preferably at least 80 wt. %, most preferably 90 wt. %, 100 wt. % or more, of the amount theoretically required to convert all of the sodium acetate to sodium acetate trihydrate ($Na(CH_3COO).3H_2O$). The hyperstoichiometric use of water is particularly preferred. With respect to the compositions according to the invention, this means that when (anhydrous) sodium acetate is used alone or in combination with a hydrate thereof, preferably the trihydrate, water is also used, the amount of water being at least equal to the amount that would be stoichiometrically required to ensure that at least 60 wt. % of the total amount of sodium acetate and its hydrates, preferably at least 70 wt. %, more preferably at least 80 wt. %, even more preferably at least 90 wt. %, most preferably at least 100 wt. %, is present in the form of sodium acetate trihydrate. As already described above, it is particularly preferred for the amount of water to exceed the amount that would be theoretically required to convert all of the sodium acetate to the corresponding trihydrate. This means, for example, that a composition containing 50 wt. % anhydrous sodium acetate and no hydrate thereof contains at least 19.8 wt. % water (60% of 33 wt. %, which would be theoretically required to convert all of the sodium acetate to the trihydrate).

In a further aspect, this application therefore relates to a solid, particulate composition comprising, based on the total weight of the composition, a) 12 to 57 wt. % sodium acetate;

b) 0.1 to 20 wt. % fragrance;

c) 0.1 to 30 wt. % of at least one textile-care compound;

d) water in an amount that is sufficient to convert at least 60 wt. %, preferably at least 70 wt. %, more preferably at least 80 wt. %, most preferably at least 100 wt. %, of the sodium acetate (a) to sodium acetate trihydrate.

If the particulate composition is described with reference to the sodium acetate content thereof, compositions which contain the sodium acetate in an amount of from 18 to 57 wt. %, preferably 24 to 48 wt. % in particular 27 to 45 wt. %, based on the total weight of the composition, are particularly advantageous with regard to their manufacturability, packaging and handling.

In addition to the carrier material a), the solid particulate compositions contain a fragrance b) as the second essential constituent. The proportion by weight of the fragrance with respect to the total weight of the composition is preferably 1 to 15 wt. %, more preferably 3 to 12 wt. %.

A fragrance is a chemical substance that stimulates the sense of smell. In order to be able to stimulate the sense of smell, it should be possible to at least partially distribute the chemical substance in the air, i.e. the fragrance should be volatile at 25° C. at least to a small extent. If the fragrance is very volatile, the odor intensity abates quickly. At a lower volatility, however, the smell lasts longer, i.e. it does not disappear as quickly. In one embodiment, the fragrance therefore has a melting point in the range of from −100° C. to 100° C., preferably from −80° C. to 80° C., more preferably from −20° C. to 50° C., in particular from −30° C. to 20° C. In another embodiment, the fragrance has a boiling point in the range of from 25° C. to 400° C., preferably from 50° C. to 380° C., more preferably from 75° C. to 350° C., in particular from 100° C. to 330° C.

Overall, in order to act as a fragrance, a chemical substance should not exceed a certain molecular mass since, if the molecular mass is too high, the required volatility can no longer be ensured. In one embodiment, the fragrance has a molecular mass of from 40 to 700 g/mol, more preferably from 60 to 400 g/mol.

The odor of a fragrance is perceived by most people as pleasant and often corresponds to the smell of, for example, flowers, fruits, spices, bark, resin, leaves, grasses, mosses and roots. Fragrances can thus also be used to mask unpleasant odors or even to provide a substance which has no smell with a desired odor. It is possible, for example, to use individual odorant compounds, such as synthetic products of the ester, ether, aldehyde, ketone, alcohol and hydrocarbon types, as fragrances.

Fragrance compounds of the aldehyde type are, for example, adoxal (2,6,10-trimethyl-9-undecenal), anisaldehyde (4-methoxybenzaldehyde), cymene (3-(4-isopropylphenyl)-2-methylpropanal), ethylvanillin, Florhydral (3-(3-isopropylphenyl)butanal), Helional (3-(3,4-methylenedioxyphenyl)-2-methylpropanal), heliotropin, hydroxycitronellal, lauraldehyde, Lyral (3- and 4-(4-hydroxy-4-methylpentyl)-3-cyclohexene-1-carboxaldehyde), methylnonylacetaldehyde, Lilial (3-(4-tert-butylphenyl)-2-methylpropanal), phenylacetaldehyde, undecylenealdehyde, vanillin, 2,6,10-trimethyl-9-undecenal, 3-dodecen-1-al, alpha-n-amylcinnamaldehyde, melonal (2,6-dimethyl-5-heptenal), 2,4-di-methyl-3-cyclohexene-1-carboxaldehyde (Triplal), 4-methoxybenzaldehyde, benzaldehyde, 3-(4-tert-butylphenyl)-propanal, 2-methyl-3-(para-methoxyphenyl) propanal, 2-methyl-4-(2,6,6-timethyl-2(1)-cyclohexen-1-yl) butanal, 3-phenyl-2-propenal, cis-/trans-3,7-dimethyl-2,6-octadien-1-al, 3,7-dimethyl-6-octen-1-al, [(3,7-dimethyl-6-octenyl)oxy]acetaldehyde, 4-isopropylbenzylaldehyde, 1,2,3,4,5,6,7,8-octahydro-8,8-dimethyl-2-naphthaldehyde, 2,4-dimethyl-3-cyclohexene-1-carboxaldehyde, 2-methyl-3-(isopropylphenyl)propanal, 1-decanal, 2,6-dimethyl-5-heptenal, 4-(tricyclo[5.2.1.0(2,6)]-decylidene-8)-butanal, octahydro-4,7-methane-1H-indenecarboxaldehyde, 3-ethoxy-4-hydroxybenzaldehyde, para-ethyl-alpha, alpha-dimethylhydrocinnamaldehyde, alpha-methyl-3,4-(methylenedioxy)-hydrocinnamaldehyde, 3,4-methylenedioxybenzaldehyde, alpha-n-hexylcinnamaldehyde, m-cymene-7-carboxaldehyde, alpha-methylphenylacetaldehyde, 7-hydroxy-3,7-dimethyloctanal, undecenal, 2,4,6-trimethyl-3-cyclohexene-1-carboxaldehyde, 4-(3)(4-methyl-3-pentenyl)-3-cyclohexene carboxaldehyde, 1-dodecanal, 2,4-dimethylcyclohexene-3-carboxaldehyde, 4-(4-hydroxy-4-methylpentyl)-3-cyclohexene-1-carboxaldehyde, 7-methoxy-3,7-dimethyloctan-1-al, 2-methyl-undecanal, 2-methyldecanal, 1-nonanal, 1-octanal, 2,6,10-trimethyl-5,9-undecadienal, 2-methyl-3-(4-tert-butyl)propanal, dihydrocinnamaldehyde, 1-methyl-4-(4-methyl-3-pentenyl)-3-cyclohexene-1-carboxaldehyde, 5- or 6-methoxyhexahydro-4,7-methanindan-1- or 2-carboxaldehyde, 3,7-dimethyloctan-1-al, 1-undecanal, 10-undecen-1-al, 4-hydroxy-3-methoxybenzaldehyde, 1-methyl-3-(4-methylpentyl)-3-cyclohexenecarboxaldehyde, 7-hydroxy-3J-dimethyloctanal, trans-4-decenal, 2,6-nonadienal, para-tolylacetaldehyde, 4-methylphenylacetaldehyde, 2-methyl-4-(2,6,6-trimethyl-1-cyclohexen-1-yl)-2-butenal, ortho-methoxycinnamaldehyde, 3,5,6-trimethyl-3-cyclohexenecarboxaldehyde, 3J-dimethyl-2-methylene-6-octenal, phenoxyacetaldehyde, 5,9-dimethyl-4,8-decadienal, peonyaldehyde (6,10-dimethyl-3-oxa-5,9-undecadien-1-al), hexahydro-4,7-methanindan-1-carboxaldehyde, 2-methyloctanal, alpha-methyl-4-(1-methylethyl)benzeneacetaldehyde, 6,6-dimethyl-2-norpinene-2-propionaldehyde, para-methylphenoxyacetaldehyde, 2-methyl-3-phenyl-2-propen-1-al, 3,5,5-trimethylhexanal, hexahydro-8,8-dimethyl-2-naphthaldehyde, 3-propyl-bicyclo-[2.2.1]-hept-5-ene-2-carbaldehyde, 9-decenal, 3-methyl-5-phenyl-1-pentanal, methylnonylacetaldehyde, hexanal and trans-2-hexenal.

Fragrance compounds of the ketone type are, for example, methyl-beta-naphthyl ketone, musk indanone (1,2,3,5,6,7-hexahydro-1,1,2,3,3-pentamethyl-4H-inden-4-one), tonalide (6-acetyl-1,1,2,4,4,7-hexamethyltetralin), alpha-damascone, beta-damascone, delta-damascone, iso-damascone, damascenone, methyldihydrojasmonate, menthone, carvone, camphor, Koavone (3,4,5,6,6-pentamethylhept-3-en-2-one), fenchone, alpha-ionone, beta-ionone, gamma-methyl-ionone, fleuramone (2-heptylcyclopentanone), dihydrojasmone, cis-jasmone, Iso-E-Super (1-(1,2,3,4,5,6J,8-octahydro-2,3,8,8-tetramethyl-2-naphthalenyl)-ethan-1-one (and isomers)), methyl cedrenyl ketone, acetophenone, methyl acetophenone, para-methoxy acetophenone, methyl beta-naphthyl ketone, benzyl acetone, benzophenone, para-hydroxyphenyl butanone, celery ketone (3-methyl-5-propyl-2-cyclohexenone), 6-i sopropyldecahydro-2-naphthone, dimethyloctenone, frescomenthe (2-butan-2-yl-cyclohexan-1-one), 4-(1-ethoxyvinyl)-3,3,5,5-tetramethylcyclohexanone, methylheptenone, 2-(2-(4-methyl)-3-cyclohexen-1-yl)propyl)cyclopentanone, 1-(p-menthen-6(2)-yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)-indanone, 4-damascol, Dulcinyl (4-(1,3-benzodioxol-5-yl)butan-2-one), Hexalone (1-(2,6,6-trimethyl-2-cyclohexen-1-yl)-1,6-heptadien-3-one), Isocyclemone E (2-acetonaphthone-1,2,3,4,5,6,7,8-octahydro-2,3,8,8-tetramethyl), methyl nonylketone, methylcyclocitrone, methyl lavender ketone, Orivone (4-tert-amylcyclohexanone), 4-tert-butylcyclohexanone, Delphone (2-pentyl-cyclopentanone), muscone (CAS 541-91-3), Neobutenone (1-(5,5-dimethyl-1-cyclohexenyl)pent-4-en-1-one), plicatone (CAS 41724-19-0), Veloutone (2,2,5-trimethyl-5-pentylcyclopentan-1-one), 2,4,4,7-tetramethyl-oct-6-en-3-one and tetramerane (6,10-dimethylundecen-2-one).

Fragrance compounds of the alcohol type are, for example, 10-undecen-1-ol, 2,6-dimethylheptan-2-ol, 2-methylbutanol, 2-methylpentanol, 2-phenoxyethanol, 2-phenylpropanol, 2-tert-butycyclohexanol, 3,5,5-trimethylcyclohexanol, 3-hexanol, 3-methyl-5-phenylpentanol, 3-octanol, 3-phenyl-propanol, 4-heptenol, 4-isopropylcyclohexanol, 4-tert-butycyclohexanol, 6,8-dimethyl-2-nonanol, 6-nonen-1-ol, 9-decen-1-ol, α-methylbenzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethyl benzyl carbinol, dimethyl heptanol, dimethyl octanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-menthan-7-ol, phenylethyl alcohol, phenol, phenyl salicylate, tetrahydrogeraniol, tetrahydrolinalool, thymol, trans-2-cis-6-nonadicnol, trans-2-nonen-1-ol, trans-2-octenol, undecanol, vanillin, champiniol, hexenol and cinnamyl alcohol.

Fragrance compounds of the ester type are, for example, benzyl acetate, phenoxyethyl isobutyrate, p-tert-butylcyclohexyl acetate, linalyl acetate, dimethylbenzylcarbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, Floramat, Melusate, and Jasmacyclat.

Ethers include, for example, benzyl ethyl ether and Ambroxan. Hydrocarbons mainly include terpenes such as limonene and pinene.

Mixtures of different fragrances are preferably used, which together produce an appealing fragrance note. Such a mixture of fragrances may also be referred to as perfume or perfume oil. Perfume oils of this kind may also contain natural fragrance mixtures, such as those obtainable from plant sources.

Fragrances of plant origin include essential oils, such as angelica root oil, aniseed oil, arnica blossom oil, basil oil, bay oil, champaca blossom oil, citrus oil, abies alba oil, abies alba cone oil, elemi oil, eucalyptus oil, fennel oil, spruce needle oil, galbanum oil, geranium oil, ginger grass oil, guaiac wood oil, gurjun balsam oil, helichrysum oil, ho oil, ginger oil, iris oil, jasmine oil, cajeput oil, calamus oil, chamomile oil, camphor oil, cananga oil, cardamom oil, cassia oil, pine needle oil, copaiba balsam oil, coriander oil, spearmint oil, caraway oil, cumin oil, labdanum oil, lavender oil, lemon grass oil, lime blossom oil, lime oil, mandarin oil, melissa oil, mint oil, musk seed oil, muscatel oil, myrrh oil, clove oil, neroli oil, niaouli oil, olibanum oil, orange blossom oil, orange peel oil, oregano oil, palmarosa oil, patchouli oil, balsam Peru oil, petitgrain oil, pepper oil, peppermint oil, allspice oil, pine oil, rose oil, rosemary oil, sage oil, sandalwood oil, celery oil, spike lavender oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil, and ambrettolide, Ambroxan, alpha-amylcinnamaldehyde, anethole, anisaldehyde, anise alcohol, anisole, anthranilic acid methyl ester, acetophenone, benzylacetone, benzaldehyde, benzoic acid ethyl ester, benzophenone, benzyl alcohol, benzyl acetate, benzyl benzoate, benzyl formate, benzyl valerianate, borneol, bornyl acetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptyne carboxylic acid methyl ester, heptaldehyde, hydroquinone dimethyl ether, hydroxycinnamaldehyde, hydroxycinnamyl alcohol, indole, irone, isoeugenol, isoeugenol methyl ether, isosafrole, jasmine, camphor, carvacrol, carvone, p-cresol methyl ether, coumarin, p-methoxyacetophenone, methyl n-amyl ketone, methylanthranilic acid methyl ester, p-methylacetophenone, methylchavicol, p-methylquinoline, methyl beta-naphthyl ketone, methyl n-nonylacetaldehyde, methyl n-nonyl ketone, muscone, beta-naphthol ethyl ether, beta-naphthol methyl ether, nerol, n-nonylaldehyde, nonyl alcohol, n-octylaldehyde, p-oxy-acetophenone, pentadecanolide, beta-phenethyl alcohol, phenylacetic acid, pulegone, safrole, salicylic acid isoamyl ester, salicylic acid methyl ester, salicylic acid hexyl ester, salicylic acid cyclohexyl ester, santalol, sandelice, skatole, terpineol, thyme, thymol, troenan, gamma-undecalactone, vanillin, veratraldehyde, cinnamaldehyde, cinnamyl alcohol, cinnamic acid, cinnamic acid ethyl ester, cinnamic acid benzyl ester, diphenyl oxide, limonene, linalool, linalyl acetate and propionate, melusate, menthol, menthone, methyl-n-heptenone, pinene, phenylacetaldehyde, terpinyl acetate, citral, citronellal and mixtures thereof.

For the prolongation of the active substance effect, in particular of the prolonged fragrance effect, it has proven to be advantageous to encapsulate the fragrance. In a corresponding embodiment, at least some of the fragrance is used in encapsulated form (fragrance capsules), in particular in microcapsules. However, it is also possible to use the entire fragrance in encapsulated form. The microcapsules may be water-soluble and/or water-insoluble microcapsules. For example, melamine-urea-formaldehyde microcapsules, melamine-formaldehyde microcapsules, urea-formaldehyde microcapsules or starch microcapsules can be used. "Fragrance precursor" refers to compounds that release the actual fragrance only after chemical conversion/cleavage, typically by exposure to light or other environmental conditions such as pH, temperature, etc. Such compounds are often also referred to as fragrance storage substances or "pro-fragrances."

For the later effect of the composition, it has proven to be advantageous if the fragrance is selected from the group of perfume oils and fragrance capsules. The use of a combination of perfume oil and fragrance capsules is very particularly preferred. Compositions in which the weight ratio of perfume oil to perfume capsules is 30:1 to 1:20, preferably 20:1 to 1:15 and in particular 15:1 to 1:10 are particularly preferred because of the persistent, uniform fragrance thereof.

As a third essential component, the solid particulate composition contains a textile-care compound. The textile-care compound is different from the previously described water-soluble carrier material and the previously described fragrance. The proportion by weight of the textile-care compound with respect to the total weight of the composition is preferably 0.2 to 20 wt. % and in particular 0.5 to 15 wt. %.

The group of textile-care compounds includes textile-softening compounds and anti-crease compounds.

The group of textile-care compounds preferably comprises in particular:

silicones, preferably aminosilicones;
phyllosilicates, preferably bentonites;
cationic polymers;
cationic surfactants;
amphoteric surfactants;
fatty substances.

It is particularly preferred if the textile-care compound is selected from polysiloxanes, textile-softening clays, cationic polymers and mixtures thereof.

The use of polysiloxanes and/or cationic polymers as a textile-care compound in the composition is advantageous because they not only exhibit a softening effect, but also enhance the perfume impression on the laundry.

The use of softening clays as a textile-care compound in the composition is advantageous because they additionally have a water-softening effect and thus, for example, limescale on the laundry can be prevented. To achieve optimum performance, it may be preferable for the composition to contain a combination of at least two textile-care compounds.

A polysiloxane which can preferably be used has the structural unit a) $—(R^1)_2\ Si—O)_n—$, where $R^1$=independently of one another, $C_1$-$C_{30}$ alkyl, preferably $C_1$-$C_4$ alkyl, in particular methyl or ethyl and n=1 to 5000, preferably 10 to 2500, in particular 100 to 1500.

If the polysiloxane has only the structural unit a) where $R^1$=methyl, it is a polydimethylsiloxane. Polydimethylpolysiloxanes are known as efficient textile-care compounds. Suitable polydimethylsiloxanes include DC-200 (from Dow Corning), Baysilone® M 50, Baysilone® M 100, Baysilone® M 350, Baysilone® M 500, Baysilone® M 1000, Baysilone® M 1500, Baysilone® M 2000 or Baysilone® M 5000 (all from GE Bayer Silicones).

The polysiloxane preferably also has the structural unit b) $—(R^1)(YNR^2R^3)Si—O)_x—$, where $R^1$=$C_1$-$C_{30}$ alkyl, preferably $C_1$-$C_4$ alkyl, in particular methyl or ethyl, Y= optionally substituted, linear or branched $C_1$-$C_{20}$ alkylene, preferably $—(CH_2)_m—$ where m=1 to 16, preferably 1 to 8, in particular 2 to 4, in particular 3, $R^2$, $R^3$=independently of one another, H or optionally substituted, linear or branched $C_1$-$C_{30}$ alkyl, preferably $C_1$-$C_{30}$ alkyl substituted with amino groups, particularly preferably $—(CH_2)_b—NH_2$ where b=1 to 10, extremely preferably b=2 and x=1 to 5000, preferably 10 to 2500, in particular 100 to 1500.

A particularly preferred polysiloxane has the following structure: $(CH_3)_3Si—[O—Si(CH_3)_2]_n—[O—Si(CH_3)\{(CH_2)_3—NH—(CH_2)_2—NH_2\}]_x—OSi(CH_3)_3$, where the sum n+x is a number between 2 and 10,000.

In various preferred embodiments of the invention, the compositions may contain at least one aminosiloxane as a silicone oil. This can be selected, for example, from the group comprising amodimethicone/morpholinomethyl silsesquioxane copolymer (CAS No. 1293390-78-9), trideceth-9 PG-amodimethicone (CAS No. 943769-53-7), dimethyl, methyl (aminoethylaminoisobutyl) siloxane hydroxy-terminated with methylsilsesquioxane (CAS No. 863918-80-3) and dimethyl, methyl (aminoethylaminoisobutyl) siloxane (CAS No. 106842-44-8). Amodimethicone/morpholinomethyl silsesquioxane copolymer (CAS No. 1293390-78-9), which is commercially available as Belsil® ADM 8301 E (Wacker Chemie), is particularly preferred.

Aminosiloxanes can additionally be used in order to improve the water-absorption capability and the re-wettability of the treated textiles and in order to facilitate ironing of the treated textiles. In addition, they improve the rinsing behavior of the agent according to the invention due to their foam-inhibiting properties. If an agent is mentioned in the present application, this is understood to mean the softener.

A suitable textile-softening phyllosilicate is, for example, a smectite clay. Preferred smectite clays are beidellite clays, hectorite clays, laponite clays, montmorillonite clays, nontropreferablynite clays, saponite clays, sauconite clays, and mixtures thereof. Montmorillonite clays are the preferred softening clays. Bentonites contain primarily montmorillonites and may be used as a preferred source for the textile-softening clay. The bentonites may be used as powder or crystals.

Suitable bentonites are sold, for example, under the names Laundrosil® by Süd-Chemie or under the name Detercal by Laviosa. It is preferable for the textile-care composition to contain a powdered bentonite as a textile-care compound.

Suitable cationic polymers include, in particular, those described in "CTFA International Cosmetic Ingredient Dictionary," fourth edition, J. M. Nikitakis, et al., Editors, published by the Cosmetic, Toiletry, and Fragrance Association, 1991, and collectively referred to as "polyquaternium." In the following, some suitable polyquaternium compounds are listed in more detail. POLYQUATERNIUM-1 (CAS No.: 68518-54-7), POLYQUATERNIUM-2 (CAS No.: 63451-27-4), POLYQUATERNIUM-3, POLYQUATERNIUM-4 (CAS No.: 92183-41-0), POLYQUATERNIUM-5 (CAS No.: 26006-22-4), POLYQUATERNIUM-6 (CAS No.: 26062-79-3), POLYQUATERNIUM-7 (CAS No.: 26590-05-6), POLYQUATERNIUM-8, POLYQUATERNIUM-9, POLYQUATERNIUM-11 (CAS No.: 53633-54-8), POLYQUATERNIUM-12 (CAS No.: 68877-50-9), POLYQUATERNIUM-13 (CAS No.: 68877-47-4), POLYQUATERNIUM-14 (CAS No.: 27103-90-8), POLYQUATERNIUM-15 (CAS No.: 35429-19-7), POLYQUATERNIUM-16 (CAS No.: 95144-24-4), POLYQUATERNIUM-17 (CAS No.: 90624-75-2), POLYQUATERNIUM-18, POLYQUATERNIUM-19, POLYQUATERNIUM-20, POLYQUATERNIUM-21 (CAS No.: 102523-94-4), POLYQUATERNIUM-22 (CAS No.: 53694-17-0), POLYQUATERNIUM-24 (CAS No.: 107987-23-5), POLYQUATERNIUM-27, POLYQUATERNIUM-28 (CAS No.: 131954-48-8), POLYQUATERNIUM-29, POLYQUATERNIUM-30, POLYQUATERNIUM-31 (CAS No. 136505-02-7), POLYQUATERNIUM-32 (CAS No.: 35429-19-7), POLYQUATERNIUM-37 (CAS No.: 26161-33-1), POLYQUATERNIUM-44 (CAS No.: 150595-70-5), POLYQUATERNIUM-68 (CAS No.: 827346-45-2).

In a further preferred embodiment, the textile-care compound is selected from the group of cationic surfactants, in particular from the group of esterquats. The term "esterquat" as used herein refers to esters of quaternary ammonium polyols, in particular quaternary ammonium diols and/or triols, such as triethanol methyl ammonium or diethanol dimethyl ammonium, with fatty acids.

In general, the use of esterquats in cosmetic products, washing and after-treatment agents, in particular in fabric softeners, is known in the prior art. These contribute to improving the softness, reducing the static charge on the textile fabrics and reducing the drying time.

The esterquats used according to the invention are ideally liquid to pasty at temperatures around 20° C.

In various embodiments, the composition contains at least one esterquat of formula $N^+(R^1)_{4-n}((CH_2)_m—O—C(O)—R^2)_nX^-$, where each $R^1$ is, independently of one another, a substituted or unsubstituted, linear or branched alkyl or alkenyl, preferably an unsubstituted or hydroxy-substituted alkyl having 1 to 10 carbon atoms; each $R^2$ is a linear or branched, substituted or unsubstituted alkyl or alkenyl or a substituted or unsubstituted (hetero) aryl having up to 26 carbon atoms, preferably linear unsubstituted C10-26 alkyl; n is 1, 2, 3 or 4, preferably 1, 2 or 3; m is an integer from 1 to 20, preferably 1 to 4; and $X^-$ is any anion.

In various embodiments, in the compounds of formula $N^+(R^1)_{4-n}((CH_2)_m—O—C(O)—R^2)_nX^-$, where n is 2 or 3, preferably 2; and/or m 1, 2, 3 or 4, preferably 2 and/or each $R^1$, independently of one another, is selected from the group consisting of methyl, ethyl, n-propyl, iso-propyl, n-butyl, iso-butyl, hydroxymethyl, 2-hydroxyethyl, 2-hydroxypropyl and 3-hydroxypropyl, preferably a first $R^1$ is selected from methyl, ethyl, n-propyl, iso-propyl, n-butyl and iso-butyl and a second $R^1$ is selected from methyl, ethyl, n-propyl, iso-propyl, n-butyl, iso-butyl, hydroxymethyl, 2-hydroxyethyl, 2-hydroxypropyl and 3-hydroxypropyl; and/or each $R^2$, independently of one another, is selected from linear, unsubstituted $C_{12-20}$ alkyl, preferably $C_{12-18}$ alkyl; and/or $X^-$ is selected from inorganic or organic anions, in particular fluoride, chloride, bromide and methosulfate.

In a particularly preferred embodiment, the esterquat used is an esterquat of formula $N^+(R^1)_{4-n}((CH_2)_m—O—C(O)—R^2)_nX^-$, where n=2 and m=2, the first $R^1$ is selected from methyl and ethyl, preferably methyl, and the second $R^1$ is selected from methyl and 2-hydroxyethyl, preferably 2-hydroxyethyl, and each $R^2$ is linear, unsubstituted $C_{12-18}$ alkyl. Such esterquats are bis(acyloxyethyl)hydroxyethyl methylammonium compounds. The counterion is preferably methosulfate. Such esterquats are commercially available under the trade name Dehyquart® AU-57 (BASF SE, DE), for example.

Alkyl amidopropyl betaines, preferably linear C8 or C10 alkyl amidopropyl betaines, i.e. capryl amidopropyl betaine (N-(3-octanoyl)aminopropyl)-N-carboxymethyl-N,N-dimethyl-1-propanaminium) or capramidopropyl betaine (N-(3-decanoyl)aminopropyl)-N-carboxymethyl-N,N-dimethyl-1-propanaminium), or, more particularly preferably, mixtures of linear C8 and C10 alkyl amidopropyl betaines, are particularly suitable as a textile-care compound from the group of amphoteric surfactants. Such a betaine mixture is commercially available as Tegotens® B 810 from Evonik Industries, for example.

Particularly preferred solid particulate compositions contain, as a further constituent, auxiliary agents, in particular cellulose derivatives or cationically modified guar.

In addition to the essential constituents described above, the solid particulate composition can contain further optional constituents.

For example, it has proven advantageous for the manufacturability of the particulate solid composition if said composition further comprises at least one rheology modifier, preferably a solid rheology modifier.

The preferably solid rheology modifier used is preferably of such a type and in such an amount that a melt obtained by heating the composition to 70° C. has a yield point above 1 Pa, preferably above 5 Pa and in particular above 10 Pa.

The yield point is measured by means of a rotation rheometer (AR G2 from TA Instruments or a "Kinexus" from Malvern), using a plate-plate measuring system with a diameter of 40 mm and a plate spacing of 1.1 mm. The yield point is determined in a step-flow procedure in which the shear stress is increased quasistatically, i.e. by waiting for the equilibrium deformation or steady flow, from the smallest possible value to a value above the yield point. The deformation is plotted against the shear stress in a log-log graph. If a yield point is present, the curves thus obtained have a characteristic deviation. An exclusively elastic deformation takes place below the deviation. The gradient of the curve in the log-log representation is ideally one. Above the deviation, the gradient of the curve increases steeply and there is a steady flow. The shear stress value of the deviation corresponds to the yield point. If the deviation is not very sharp, the point of intersection of the tangents of the two curve portions can be used to determine the yield point. In the case of liquids that have no yield point, the graph described above is usually curved to the right.

Inorganic and organic substances having corresponding properties which influence the rheology of the molten composition can be used as rheology modifiers. These substances may be solid (at 20° C. and 1 bar) or liquid ingredients, the use of solid rheology modifiers being preferred.

The proportion by weight of the inorganic rheology modifier with respect to the total weight of the composition can be 0.1 to 25 wt. %, but is preferably 0.5 to 3 wt. %, more preferably 1 to 2.5 wt. % and in particular 1.2 to 2.0 wt. %.

The group of inorganic rheology modifiers includes, for example, pyrogenic silicic acid, which is particularly preferred due to the advantageous technical effect thereof.

The silicic acids used preferably have a BET surface area of more than 50 $m^2/g$, preferably more than 100 $m^2/g$, more preferably 150 to 250 $m^2/g$, in particular 175 to 225 $m^2/g$.

Suitable silicic acids are commercially available from Evonik under the trade names Aerosil® and Sipernat®. Aerosil® 200 is particularly preferred.

The proportion by weight of the organic rheology modifier with respect to the total weight of the composition can be 0.1 to 25 wt. %, but is preferably 0.5 to 3 wt. %, more preferably 1 to 2.5 wt. % and in particular 1.2 to 2.0 wt. %.

In the case of the organic rheology modifiers, the use of cellulose, in particular microfibrillated cellulose (MFC, nanocellulose), is preferred. Particularly suitable as cellulose are MFCs, as are commercially available as Exilva (Borregaard) or Avicel® (FMC), for example.

Another group of particularly preferred organic rheology modifiers is the heteroglycans. Polysaccharides which are made up of more than one type of monomeric simple sugar are referred to as heteroglycans.

Suitable rheology modifiers are heteroglycans of different origin, in particular heteroglycans of bacterial origin, heteroglycans of algae origin and heterogylcans of plant origin. These heteroglycans can be used individually or in combination.

Because of their availability and technical effect, rheology modifiers from the group of heteroglycans of bacterial origin are particularly preferred. The use of heteroglycans which are obtained by bacterial fermentation is particularly preferred.

Heteroglycans from the group of exopolysaccharides in particular have proven to be effective as rheology modifiers.

Preferred rheology modifiers from the group of heteroglycans are further functionalized by at least one non-saccharidic group, preferably by at least one non-saccharidic group selected from acetate, pyruvate, phosphate and succinate.

Very particularly preferred compositions contain a compound having the INCI name succinoglycan as a rheology modifier.

In summary, preferred compositions are those which, based on their total weight, comprise 0.1 to 25 wt. %, preferably 0.5 to 3 wt. %

- of an inorganic rheology modifier, preferably an inorganic rheology modifier from the group of pyrogenic silicic acids and/or
- of an organic rheology modifier, preferably an organic rheology modifier from the group of
  - i) celluloses, preferably microfibrillated celluloses and/or
  - ii) of heteroglycans, preferably a rheology modifier having the INCI name succinoglycan.

Further preferred optional constituents include shaped bodies containing active substances, dyes, preservatives, bitterns or buffer systems.

In order to improve the appearance of the shaped bodies containing the active substance, said bodies preferably comprise at least one dye. It is preferred that the shaped bodies comprise at least one water-soluble dye, particularly preferably a water-soluble polymer dye. Such dyes are known in the prior art and, based on the total weight of the composition, are typically used in concentrations of from 0.001 to 0.5 wt. %, preferably 0.01 to 0.3 wt. %.

Preferred dyes, which can be selected by a person skilled in the art without any difficulty at all, should be highly stable in storage, unaffected by the other ingredients of the washing or cleaning agent, insensitive to light and should not exhibit pronounced sub stantivity with respect to textile fibers, in order to avoid dyeing said fibers.

The dye is a conventional dye which can be used for various washing or cleaning agents. The dye is preferably selected from Acid Red 18 (CI 16255), Acid Red 26, Acid Red 27, Acid Red 33, Acid Red 51, Acid Red 87, Acid Red 88, Acid Red 92, Acid Red 95, Acid Red 249 (CI 18134), Acid Red 52 (CI 45100), Acid Violet 126, Acid Violet 48, Acid Violet 54, Acid Yellow 1, Acid Yellow 3 (CI 47005), Acid Yellow 11, Acid Yellow 23 (CI 19140), Acid Yellow 3, Direct Blue 199 (CI 74190), Direct Yellow 28 (CI 19555), Food Blue 2 (CI 42090), Food Blue 5:2 (CI 42051:2), Food Red 7 (01 16255), Food Yellow 13 (CI 47005), Food Yellow 3 (CI 15985), Food Yellow 4 (CI 19140), Reactive Green 12 and Solvent Green 7 (CI 59040).

Particularly preferred dyes are water-soluble acid dyes, for example Food Yellow 13 (Acid Yellow 3, CI 47005), Food Yellow 4 (Acid Yellow 23, CI 19140), Food Red 7 (Acid Red 18, CI 16255), Food Blue 2 (Acid Blue 9, CI 42090), Food Blue 5 (Acid Blue 3, CI 42051), Acid Red 249 (CI 18134), Acid Red 52 (CI 45100), Acid Violet 126, Acid Violet48, Acid Blue 80(01 61585), Acid Blue 182, Acid Blue 182, Acid Green 25 (CI 61570) and Acid Green 81.

Water-soluble direct dyes, for example Direct Yellow 28 (CI 19555) and Direct Blue 199 (CI 74190), and water-soluble reactive dyes, for example Reactive Green 12, and the dyes Food Yellow 3 (CI 15985) and Acid Yellow 184 are equally preferably used. Aqueous dispersions of the following pigment dyes are equally preferably used: Pigment Black 7 (CI 77266), Pigment Blue 15 (CI 74160), Pigment Blue 15:1 (CI 74160), Pigment Blue 15:3 (CI 74160), Pigment Green 7 (CI 74260), Pigment Orange 5, Pigment Red 112 (CI 12370), Pigment Red 112 (CI 12370), Pigment Red 122 (CI 73915), Pigment Red 179 (CI 71130), Pigment Red 184 (CI 12487), Pigment Red 188 (CI 12467), Pigment Red 4 (CI 12085), Pigment Red 5 (CI 12490), Pigment Red 9, Pigment Violet 23 (CI 51319), Pigment Yellow 1 (CI 28 11680), Pigment Yellow 13 (CI 21100), Pigment Yellow 154, Pigment Yellow 3 (CI 11710), Pigment Yellow 74, Pigment Yellow 83 (CI 21108) and Pigment Yellow 97. In preferred embodiments, the following pigment dyes are used in the form of dispersions: Pigment Yellow 1 (CI 11680), Pigment Yellow 3 (CI 11710), Pigment Red 112 (CI 12370), Pigment Red 5 (CI 12490), Pigment Red 181 (CI 73360), Pigment Violet 23 (CI 51319), Pigment Blue 15:1 (CI 74160), Pigment Green 7 (CI 74260) and Pigment Black 7 (CI 77266).

In equally preferred embodiments, water-soluble polymer dyes are used, for example Liquitint, Liquitint Blue HP, Liquitint Blue MC, Liquitint Blue 65, Liquitint Cyan 15, Liquitint Patent Blue, Liquitint Violet 129, Liquitint Royal Blue, Liquitint Experimental Yellow 8949-43, Liquitint Green HMC, Liquitint Yellow LP, Liquitint Yellow II and mixtures thereof. The use of water-soluble polymer dyes is preferred.

The group of very particularly preferred dyes includes Acid Blue 3, Acid Yellow 23, Acid Red 33, Acid Violet 126, Liquitint Yellow LP, Liquitint Cyan 15, Liquitint Blue HP and Liquitint Blue MC.

The addition of bitterns primarily serves to prevent oral ingestion of the shaped body containing the active substance.

Preferred shaped bodies contain at least one bittern in an amount of from 0.0001 to 0.05 wt. %, based on the total weight of the composition. Amounts of from 0.0005 to 0.02 wt. % are particularly preferred. According to the present invention, bitterns which are soluble in water at 20° C. to at least 5 g/l are particularly preferred. With regard to an undesired interaction with the fragrance components also contained in the composition, in particular a change in the fragrance note perceived by the consumer, the ionogenic bitterns have proven to be superior to the non-ionogenic bitterns. Ionogenic bitterns consisting of organic cation(s) and organic anion(s) are consequently preferred for the composition according to the invention.

In various embodiments, the at least one bittern is therefore an ionogenic bittern.

Quaternary ammonium compounds which contain an aromatic group both in the cation and in the anion are exceptionally suitable in the context of the present invention. In various embodiments, the at least one bittern is therefore a quaternary ammonium compound.

A suitable quaternary ammonium compound is, for example, without limitation, benzyldiethyl ((2,6-xylylcarbamoyl)methyl)ammonium benzoate, which is commercially available under the trade names Bitrex® and Indigestin®. This compound is also known under the name denatonium benzoate. In various embodiments, the at least one bittern is benzyldiethyl ((2,6-xylylcarbamoyl)methyl) ammonium benzoate (Bitrex®). If Bitrex® is used, weight proportions of 0.0001 to 0.05 wt. % are preferred. The information is in each case based on the active substance content and the total weight.

The composition also contains at least one buffer system. The buffer system is preferably solid, i.e. it is a solid (mixture) under standard conditions. The term "buffer capacity" in this case refers to the amount of hydrogen chloride (HCl) in mg that is necessary to adjust the pH of a solution of 1 g of the solid composition in 50 g of deionized water under standard conditions (20° C., 1013 mbar) to fall to below 6.75. The buffer systems used according to the invention are preferably characterized in that they have a pKa value of at least 5.75, preferably at least 6.25, more preferably at least 6.75, and preferably no more than 12, more preferably less than 11.5, even more preferably 11 or less, most preferably 10.5 or less. The buffering capacity of the resulting solution is preferably at least 2 mg HCl/g composition, preferably at least 3 mg HCl/g composition, more preferably at least 4 mg HCl/g composition.

Suitable buffer substances are, for example, without limitation, sodium hydrogen carbonate, sodium carbonate, disodium hydrogen phosphate, sodium glutamate, sodium aspartate, tris(hydroxymethyl)aminomethane (TRIS) and other organic and inorganic buffer substances known in the prior art that meet the above criteria, and mixtures of the aforementioned substances. TRIS is particularly preferred.

The buffer substances in the compositions according to the invention are used, for example, in amounts of from 0.1 to 10 wt. %, preferably 0.5 to 7.5 wt. %, more preferably 1 to 5 wt. %, in each case based on the total weight of the composition, and are preferably selected from sodium hydrogen carbonate, sodium carbonate, disodium hydrogen phosphate, sodium glutamate, sodium aspartate, tris(hydroxymethyl)aminomethane (TRIS) and combinations thereof, preferably tris(hydroxymethyl)aminomethane.

The composition preferably does not contain polyethylene glycol (PEG) that is solid at room temperature (25° C.) in the form of a coating, more preferably the composition does not contain any PEG that is solid at room temperature (25° C.), i.e., the content of PEG that is solid at room temperature (25° C.) is less than 1 wt. % based on the composition.

As stated at the outset, the compositions according to the invention are distinguished by comparison with the known compositions of the prior art by an improved solubility profile and an improved fragrance effect. At the same time, however, these compositions tend to produce unesthetic "salt efflorescence" on the surface thereof, depending on the exact manufacturing and/or storage conditions. These particle surface changes particularly affect the appearance of dye-containing compositions. Another object was therefore to prevent or at least mitigate this efflorescence by means of formulation measures.

Surprisingly, it has been found that the above-described unesthetic surface changes of the compositions can be prevented by the addition of at least one water-miscible organic solvent. For this reason, the compositions according to the invention contain at least one water-miscible organic solvent as another essential constituent.

The water-miscible organic solvents are preferably less volatile and odorless. Suitable water-miscible organic solvents are, for example, monohydric and polyhydric alcohols, alkyl ethers, dimolecular or low-molecular-weight polyalkylene ethers which are liquid at room temperature. The solvents are preferably selected from ethanol, n-propanol, i-propanol, butanols, glycol, propanediol, butanediol, methylpropanediol, diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether (1,2-propanediol) and mixtures of these solvents.

Particular preference is given to dipropylene glycol, 1,2-propylene glycol and glycerol, since they are particularly readily miscible with water and also do not undergo any adverse reactions with the other constituents of the composition. Dipropylene glycol is particularly preferred.

The proportion by weight of the water-miscible organic solvent with respect to the total weight of the composition is preferably 0.1 to 20 wt. %, more preferably 0.1 to 10 wt. %, particularly preferably 0.5 to 8 wt. %, and in particular 1 to 6 wt. %.

As described above, the composition may potentially also contain free water. The term "free water," as used herein, refers to water which is not bound as water of crystallization in any of the salts contained in the composition.

The solid particulate composition can have any shape. For reasons of manufacturability, packaging, handling behavior and metering, preference is given to spherical, figurative, scaled, cuboid, cylindrical, conical, spherical-cap-shaped or lenticular, hemispherical, disc-shaped or acicular particles. Exemplary particles can have a gummy bear-like, figurative design. On account of their packaging properties and their performance profile, hemispherical particles are particularly preferred.

It is furthermore preferred for the composition to consist of at least 20 wt. %, preferably at least 40 wt. %, particularly preferably at least 60 wt. % and more particularly preferably at least 80 wt. % of particles which have a spatial extension of from 0.5 to 10 mm, in particular 0.8 to 7 mm and particularly preferably 1 to 5 mm, in any spatial direction.

It is furthermore preferred for at least 20 wt. %, preferably at least 40 wt. %, more preferably at least 60 wt. % and particularly preferably at least 80 wt. % of the composition to consist of particles in which the ratio of the longest particle diameter determined in any spatial direction to the shortest diameter determined in any spatial direction is between 3:1 and 1:1, preferably between 2.5:1 and 1.2:1 and in particular between 2.2:1 and 1.4:1.

The weight of the solid particles of the composition can also vary within wide limits. With regard to the manufacturability and metering properties, however, compositions have proven to be advantageous of which at least 20 wt. %, preferably at least 40 wt. %, particularly preferably at least 60 wt. % and more particularly preferably at least 80 wt. % consists of particles which have a particle weight between 2 and 150 mg, preferably between 8 and 120 mg and in particular between 20 and 100 mg.

The solid particulate composition can be marketed or used alone or in combination with another preparation. In a preferred embodiment, the solid particulate composition is a constituent of a washing or cleaning agent.

As mentioned at the outset, the composition is primarily suitable for fragrancing textiles. The use of the solid composition, or of a washing or cleaning agent which contains this composition, as a textile-care agent for fragrancing textile fabrics is therefore a further aspect of this application.

Due to the addition of a textile-care compound, the solid, particulate composition can also be used as a textile-care agent for softening textile fabrics or for providing textile fabrics with anti-crease properties.

A composition as described herein may be used for example in the wash cycle of a laundry cleaning process and thus may transport the perfume to the laundry right at the beginning of the washing process. Furthermore, the composition is easier and better to handle than liquid compositions since, during subsequent storage of the bottle, no drops are left on the edge of the bottle that run down to the edges on the ground or result in unpleasant deposits in the region of the bottle cap. The same applies to the case in which, during metering, some of the composition is accidentally spilled. The amount spilled can also be removed more easily and cleanly. This application further relates to a method for the treatment of textiles, in the course of which a composition according to the invention, or a washing or cleaning agent which comprises a composition of this kind, is metered into the wash liquor of a textile washing machine.

The composition of some preferred compositions can be found in the following tables (amounts given in wt. % based on the total weight of the agent, unless otherwise indicated).

| | Formula 1 | Formula 2 | Formula 3 | Formula 4 | Formula 5 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Textile-care compound | 0.1 to 30 | 0.2 to 20 | 0.2 to 20 | 0.5 to 15 | 0.5 to 15 |
| Misc. | up to 100 | up to 100 | up to 100 | up to 100 | up to 100 |

| | Formula 6 | Formula 7 | Formula 8 | Formula 9 | Formula 10 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Silicone, preferably amino silicone | 0.1 to 30 | 0.2 to 20 | 0.2 to 20 | 0.5 to 15 | 0.5 to 15 |
| Misc. | up to 100 | up to 100 | up to 100 | up to 100 | up to 100 |

| | Formula 11 | Formula 12 | Formula 13 | Formula 14 | Formula 15 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Cationic polymer | 0.1 to 30 | 0.2 to 20 | 0.2 to 20 | 0.5 to 15 | 0.5 to 15 |
| Misc. | up to 100 | up to 100 | up to 100 | up to 100 | up to 100 |

| | Formula 16 | Formula 17 | Formula 18 | Formula 19 | Formula 20 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Cationic surfactant | 0.1 to 30 | 0.2 to 20 | 0.2 to 20 | 0.5 to 15 | 0.5 to 15 |
| Misc. | up to 100 | up to 100 | up to 100 | up to 100 | up to 100 |

| | Formula 21 | Formula 22 | Formula 23 | Formula 24 | Formula 25 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Amphoteric surfactant | 0.1 to 30 | 0.2 to 20 | 0.2 to 20 | 0.5 to 15 | 0.5 to 15 |
| Misc. | up to 100 | up to 100 | up to 100 | up to 100 | up to 100 |

| | Formula 26 | Formula 27 | Formula 28 | Formula 29 | Formula 30 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Textile-care compound | 0.1 to 30 | 0.2 to 20 | 0.2 to 20 | 0.5 to 15 | 0.5 to 15 |
| Misc. | up to 100 | up to 100 | up to 100 | up to 100 | up to 100 |

* Weight ratio of perfume oil to fragrance capsules 30:1 to 1:20, preferably 20:1 to 1:15 and in particular 15:1 to 1:10

| | Formula 31 | Formula 32 | Formula 33 | Formula 34 | Formula 35 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Silicone, preferably amino silicone | 0.1 to 30 | 0.2 to 20 | 0.2 to 20 | 0.5 to 15 | 0.5 to 15 |
| Misc. | up to 100 | up to 100 | up to 100 | up to 100 | up to 100 |

* Weight ratio of perfume oil to fragrance capsules 30:1 to 1:20, preferably 20:1 to 1:15 and in particular 15:1 to 1:10

| | Formula 36 | Formula 37 | Formula 38 | Formula 39 | Formula 40 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Cationic polymer | 0.1 to 30 | 0.2 to 20 | 0.2 to 20 | 0.5 to 15 | 0.5 to 15 |
| Misc. | up to 100 | up to 100 | up to 100 | up to 100 | up to 100 |

* Weight ratio of perfume oil to fragrance capsules 30:1 to 1:20, preferably 20:1 to 1:15 and in particular 15:1 to 1:10

| | Formula 41 | Formula 42 | Formula 43 | Formula 44 | Formula 45 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Cationic surfactant | 0.1 to 30 | 0.2 to 20 | 0.2 to 20 | 0.5 to 15 | 0.5 to 15 |
| Misc. | up to 100 | up to 100 | up to 100 | up to 100 | up to 100 |

* Weight ratio of perfume oil to fragrance capsules 30:1 to 1:20, preferably 20:1 to 1:15 and in particular 15:1 to 1:10

| | Formula 46 | Formula 47 | Formula 48 | Formula 49 | Formula 50 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Amphoteric surfactant | 0.1 to 30 | 0.2 to 20 | 0.2 to 20 | 0.5 to 15 | 0.5 to 15 |
| Misc. | up to 100 | up to 100 | up to 100 | up to 100 | up to 100 |

* Weight ratio of perfume oil to fragrance capsules 30:1 to 1:20, preferably 20:1 to 1:15 and in particular 15:1 to 1:10

| | Formula 51 | Formula 52 | Formula 53 | Formula 54 | Formula 55 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Textile-care compound | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

| | Formula 56 | Formula 57 | Formula 58 | Formula 59 | Formula 60 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Silicone, preferably amino silicone | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

| | Formula 61 | Formula 62 | Formula 63 | Formula 64 | Formula 65 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |

-continued

| | | | | | |
|---|---|---|---|---|---|
| Cationic polymer | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

| | Formula 66 | Formula 67 | Formula 68 | Formula 69 | Formula 70 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Cationic surfactant | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

| | Formula 71 | Formula 72 | Formula 73 | Formula 74 | Formula 75 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Amphoteric surfactant | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

| | Formula 76 | Formula 77 | Formula 78 | Formula 79 | Formula 80 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Textile-care compound | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

| | Formula 81 | Formula 82 | Formula 83 | Formula 84 | Formula 85 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Silicone, preferably amino silicone | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

* Weight ratio of perfume oil to fragrance capsules 30:1 to 1:20, preferably 20:1 to 1:15 and in particular 15:1 to 1:10

40

| | Formula 86 | Formula 87 | Formula 88 | Formula 89 | Formula 90 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Cationic polymer | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

* Weight ratio of perfume oil to fragrance capsules 30:1 to 1:20, preferably 20:1 to 1:15 and in particular 15:1 to 1:10

| | Formula 91 | Formula 92 | Formula 93 | Formula 44 | Formula 95 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Cationic surfactant | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

* Weight ratio of perfume oil to fragrance capsules 30:1 to 1:20, preferably 20:1 to 1:15 and in particular 15:1 to 1:10

| | Formula 96 | Formula 97 | Formula 98 | Formula 99 | Formula 100 |
|---|---|---|---|---|---|
| Sodium acetate trihydrate | 20 to 95 | 30 to 95 | 30 to 95 | 40 to 90 | 45 to 90 |
| Perfume oil and fragrance capsules * | 0.1 to 20 | 0.1 to 20 | 1.0 to 15 | 1.0 to 15 | 3.0 to 12 |
| Amphoteric surfactant | 0.1 to 30 | 0.2 to 20 | 0.2 to 20 | 0.5 to 15 | 0.5 to 15 |
| Water-miscible organic solvent | 0.1 to 20 | 0.1 to 10 | 0.1 to 10 | 0.1 to 10 | 0.5 to 8.0 |
| Misc. | up to 100 | up to 100 | up to 100 | up to 100 | up to 100 |

* Weight ratio of perfume oil to fragrance capsules 30:1 to 1:20, preferably 20:1 to 1:15 and in particular 15:1 to 1:10

In various embodiments of the invention, the melt bodies according to the invention are coated. Suitable coating agents are, for example, tablet coatings known from pharmaceutical literature. However, the pastilles can also be waxed, i.e. coated with a wax, or, to protect against caking (agglomeration), can be powder-coated with a powdered material, for example a release agent. It is preferred for the coating not to consist of PEG or to comprise it in any significant amount (>10 wt. %, based on the coating).

A method for preparing melt bodies of this kind may comprise the following steps:

a) producing a melt comprising the at least one water-soluble carrier material;
b) metering the fragrance and the textile-care compound into the melt;
c) mixing the melt, the fragrance and the textile-care compound; and
d) cooling and optionally reshaping the mixture to obtain perfume-containing melt bodies.

In a preferred embodiment, the melt dispersion prepared in step a) is discharged from the first container and fed to the drop former by means of a pipe. It is further preferred for the fragrance to be continuously introduced into the outlet stream of the first container by means of a further pipe from a corresponding storage container. A liquid preparation of the fragrance, for example in the form of a solution, is particularly suitable for this purpose. The temperature of the fragrance or of the liquid preparation of the fragrance, before being introduced into the outlet stream of the first container, is preferably at least 10° C., more preferably at least 20° C. and in particular at least 30° C. below the temperature of the melt dispersion forming the outlet stream.

It is further preferred to mix the resulting mixture in the pipe after the fragrance has been introduced into the melt dispersion. Mixing is preferably carried out by means of a static mixer which is located in the pipe in the direction of flow of the melt dispersion, after the point of entry of the fragrance and before the point of entry of the mixture into the drop former.

The length of the static mixer mounted in the pipe in the flow direction of the melt dispersion is preferably at least 10 times, preferably at least 20 times and in particular at least 50 times the diameter of the pipe. In order to ensure an optimal mixing of the melt dispersion and the fragrance, the distance between the end of the static mixer and the entry point of the pipe into the drop former is less than 500 times, preferably less than 200 times and in particular less than 100 times the diameter of the pipe. The diameter of the pipe refers to the internal diameter of the pipe, without taking the wall thickness into account.

From the pipe, the mixture of melt dispersion and fragrance enters the drop former, which has a rotating, perforated outer drum. The portion of the pipe that is located inside the drum of the drop former is referred to below as the feed channel, in order to distinguish said portion from the previous pipe. The feed channel preferably extends over at least 80%, particularly preferably over at least 90% and in particular over 100% of the length of the drum of the drop former.

The mixture introduced into the feed channel preferably exits the feed channel through bores located on the lower face of the feed channel, from the feed channel onto a distributor or nozzle strip, which in turn rests on the inner face of the rotating, perforated outer drum. The mixture passes through the distributor or nozzle strip and is subsequently applied from the holes in the rotating outer drum to a steel belt located below said holes. The distance between the outer face of the rotating, perforated outer drum and the surface of the steel belt is preferably between 5 and 20 mm.

A further mixer can be arranged in the feed channel in order to further improve the mixing of the melt dispersion and the fragrance, and to prevent or minimize sedimentation. This is preferably a dynamic mixer, for example a helix which is rotatably arranged within the feed channel.

In order to minimize the thermal load on the fragrance, the time the mixture of melt dispersion and fragrance spends in the pipe before emerging from the rotating, perforated outer drum of the drop former is preferably less than 20 seconds, particularly preferably less than 10 seconds and in particular between 0.5 and 5 seconds.

The viscosity (Texas Instruments AR-G2 rheometer, plate/plate, 4 cm diameter, 1,100 μm column, shear rate 10/1 sec) of the mixture as it exits the rotating, perforated outer drum is preferably between 1,000 and 10,000 mPas.

The droplets of the mixture that are discharged from the drop former are solidified on the steel belt so as to form solid melt bodies. The period of time between the dropping of the mixture onto the steel belt and the complete solidification of the mixture is preferably between 5 and 60 seconds, particularly preferably between 10 and 50 seconds and in particular between 20 and 40 seconds.

The solidification of the mixture is preferably supported and accelerated by cooling. The cooling of the drops applied to the steel belt can be direct or indirect. As direct cooling, for example, cooling by means of cold air can be used. However, indirect cooling of the drops by cooling the lower face of the steel belt using cold water is preferred.

A preferred method therefore comprises the steps of:

a) producing, preferably continuously producing and conveying, a melt comprising the at least one water-soluble carrier material;
b) metering the textile-care compound into the melt;
c) subsequently metering in the fragrance;
d) applying drops of the resulting mixture to a cooling belt by means of a drop former having a rotating, perforated outer drum; and
e) solidifying the drops of the mixture on the steel belt to form solid melt bodies.

In summary, the present invention provides, inter alia:

1. A solid particulate composition comprising, based on the total weight of the composition,
   a) 20 to 95 wt. % of at least one water-soluble carrier material selected from hydrous salts of which the water vapor partial pressure corresponds, at a specific temperature in the range of from 30 to 100° C., to the $H_2O$ partial pressure of the saturated solution of said salt;
   b) 0.1 to 20 wt. % fragrance;
   c) 0.1 to 30 wt. % of at least one textile-care compound.
2. The composition according to point 1, characterized in that the water-soluble carrier material is selected from hydrous salts of which the water vapor partial pressure, at a temperature in the range of from 40 to 90° C., preferably from 50 to 85° C., more preferably from 55 to 80° C., corresponds to the $H_2O$ partial pressure of the saturated solution of said salt, and is preferably sodium acetate trihydrate ($Na(CH_3COO).3H_2O$).
3. The composition according to one of points 1 or 2, characterized in that the water-soluble carrier material is contained in the composition in an amount of from 30 to 95 wt. %, preferably from 40 to 90 wt. %, in particular from 45 to 90 wt. %, based on the total weight of said composition.
4. A solid particulate composition comprising:
   a) 20 to 95 wt. %, based on the total weight of the composition, sodium acetate trihydrate;
   b) 0.1 to 20 wt. % fragrance;
   c) 0.1 to 30 wt. % of at least one textile-care compound.
5. The composition according to point 4, characterized in that the sodium acetate trihydrate is contained in the composition in an amount of from 30 to 95 wt. %, preferably from 40 to 90 wt. %, in particular from 45 to 90 wt. %, based on the total weight of said composition.
6. A solid particulate composition comprising, based on the total weight of the composition,
   a) 12 to 57 wt. % sodium acetate;
   b) 0.1 to 20 wt. % fragrance;
   c) 0.1 to 30 wt. % of at least one textile-care compound;
   d) water in an amount that is sufficient to convert at least 60 wt. %, preferably at least 70 wt. %, more preferably at least 80 wt. %, most preferably at least 100 wt. %, of the sodium acetate (a) to sodium acetate trihydrate.
7. The composition according to point 6, characterized in that the sodium acetate is contained in the composition in an amount of from 18 to 57 wt. %, preferably from 24 to 48 wt. %, in particular from 27 to 45 wt. %, based on the total weight of said composition.
8. The composition according to one of the preceding points, characterized in that the fragrance is contained in the composition in an amount of from 1 to 15 wt. %, more preferably 3 to 12 wt. %.
9. The composition according to one of the preceding points, characterized in that the fragrance comprises perfume oil and fragrance capsules, the weight ratio of perfume oil to fragrance capsules being 30:1 to 1:20, preferably 20:1 to 1:15 and in particular 15:1 to 1:10.
10. The composition according to one of the preceding points, characterized in that the composition, based on the total weight thereof, comprises 0.2 to 20 wt. %, preferably 0.5 to 15 wt. % textile-care compound.
11. The composition according to one of the preceding points, characterized in that the composition comprises a textile-care compound from the group of cationic surfactants.
12. The composition according to one of the preceding points, characterized in that the composition comprises a textile-care compound from the group of amphoteric surfactants.
13. The composition according to one of the preceding points, characterized in that the composition comprises a textile-care compound from the group of cationic polymers.
14. The composition according to one of the preceding points, characterized in that the composition comprises a textile-care compound from the group of fatty substances.
15. The composition according to one of the preceding points, characterized in that the composition comprises a textile-care compound from the group of phyllosilicates, preferably bentonites.
16. The composition according to one of the preceding points, characterized in that the composition comprises a textile-care compound from the group of silicones, preferably aminosilicones.
17. The composition according to one of the preceding points, characterized in that the composition further comprises at least one rheology modifier, preferably a solid rheology modifier.
18. The composition according to one of the preceding points, characterized in that the composition further comprises at least one rheology modifier, preferably a solid rheology modifier of such a type and in such an amount that a melt obtained by heating the composition to 70° C. has a yield point above 1 Pa, preferably above 5 Pa and in particular above 10 Pa.
19. The composition according to one of the preceding points, characterized in that the composition, based on the total weight thereof, comprises 0.1 to 25 wt. %, preferably 0.5 to 3 wt. %
    of an inorganic rheology modifier, preferably an inorganic rheology modifier from the group of pyrogenic silicic acids and/or
    of an organic rheology modifier, preferably an organic rheology modifier from the group of
    i) celluloses, preferably microfibrillated celluloses and/or
    ii) of heteroglycans, preferably a rheology modifier having the INCI name succinoglycan.
20. The composition according to one of the preceding points, characterized in that the composition contains, based on the total weight thereof, an inorganic rheology modifier in an amount of from 0.5 to 3 wt. %, preferably from 1 to 2.5 wt. %, more preferably 1.2 to 2.0 wt. %.
21. The composition according to one of the preceding points, characterized in that the composition contains, as an inorganic rheology modifier, pyrogenic silicic acid having a BET surface area of more than 50 $m^2/g$, preferably more than 100 $m^2/g$, more preferably 150 to 250 $m^2/g$, in particular 175 to 225 $m^2/g$.
22. The composition according to one of the preceding points, characterized in that the composition contains, based on the total weight thereof, an organic rheology modifier in an amount of from 0.5 to 3 wt. %, preferably from 1 to 2.5 wt. %, more preferably 1.2 to 2.0 wt. %.
23. The composition according to one of the preceding points, characterized in that the composition contains, as an organic rheology modifier, cellulose, preferably microfibrillated cellulose.

24. The composition according to one of the preceding points, characterized in that the composition contains, as an organic rheology modifier, heteroglycan, preferably from the group of
heteroglycans of bacterial origin and/or;
heteroglycans of algae origin and/or;
heteroglycans of vegetable origin.
25. The composition according to one of the preceding points, characterized in that the composition contains, as an organic rheology modifier, a heteroglycan of bacterial origin.
26. The composition according to one of the preceding points, characterized in that the composition contains, as an organic rheology modifier, a heteroglycan obtained by bacterial fermentation.
27. The composition according to one of the preceding points, characterized in that the composition contains, as an organic rheology modifier, an exopolysaccharide.
28. The composition according to one of the preceding points, characterized in that the composition contains, as an organic rheology modifier, a heteroglycan which is functionalized with at least one non-saccharidic group, preferably with at least one non-saccharidic group selected from acetate, pyruvate, phosphate and succinate.
29. The composition according to one of the preceding points, characterized in that the composition contains, as an organic rheology modifier, a compound having the INCI name succinoglycan.
30. The composition according to one of the preceding points, characterized in that the composition has at least one buffer system, preferably a solid buffer system, of such a type and in such an amount that when 1 g of the composition is dissolved in 50 g of deionized water, a pH of 12, preferably 11.5, more preferably 11, is not exceeded and the buffer capacity of the resulting solution is at least 2 mg HCl/g composition, preferably at least 3 mg HCl/g composition, more preferably at least 4 mg HCl/g composition.
31. The composition according to one of the preceding points, characterized in that the composition contains 0.1 to 10 wt. %, preferably 0.5 to 7.5 wt. %, more preferably 1 to 5 wt. % of at least one buffer system, preferably a solid buffer system selected from the group consisting of sodium hydrogen carbonate, sodium carbonate, disodium hydrogen phosphate, sodium glutamate, sodium aspartate, tris(hydroxymethyl)aminomethane (TRIS) and combinations thereof, preferably tris(hydroxymethyl)aminomethane.
32. The composition according to one of the preceding points, characterized in that the composition further contains at least one dye, preferably in a concentration of from 0.001 to 0.5 wt. %, particularly preferably 0.01 to 0.3 wt. %, based on the total weight of the composition.
33. Composition according to one of the preceding points, characterized in that the composition further comprises at least one dye from the group of water-soluble polymer dyes.
34. The composition according to one of the preceding points, characterized in that the composition contains, based on the total weight thereof, 0.0001 to 0.05 wt. %, preferably 0.0005 to 0.02 wt. %, of at least one bittern, preferably at least one ionogenic bittern, particularly preferably a quaternary ammonium compound.
35. The composition according to one of the preceding points, characterized in that the composition contains, based on the total weight thereof, 0.0001 to 0.05 wt. % benzyldiethyl((2,6-xylylcarbamoyl)methyl)ammonium benzoate.
36. The composition according to one of the preceding points, characterized in that the composition does not contain a polyethylene glycol which is solid at room temperature (25° C.) in the form of a coating.
37. The composition according to one of the preceding points, characterized in that, based on the total weight, the composition contains less than 1 wt. % of a polyethylene glycol which is solid at room temperature (25° C.).
38. The composition according to one of the preceding points, characterized in that the composition further contains free water.
39. The composition according to one of the preceding points, characterized in that the composition contains, based on the total weight thereof, 0.1 to 20 wt. %, preferably 0.1 to 10 wt. %, more preferably 0.5 to 8 wt. % and in particular 1 to 6 wt. % of at least one water-miscible organic solvent.
40. The composition according to one of the preceding points, characterized in that the composition contains a water-miscible organic solvent from the group dipropylene glycol, 1,2-propylene glycol and glycerol, preferably dipropylene glycol.
41. The composition according to one of the preceding points, characterized in that the composition is in the form of hemispherical particles.
42. The composition according to one of the preceding points, characterized in that at least 20 wt. %, preferably at least 40 wt. %, particularly preferably at least 60 wt. % and more particularly preferably at least 80 wt. %, of the composition consists of particles which have a spatial extension of between 0.5 and 10 mm, in particular 0.8 to 7 mm and particularly preferably 1 to 5 mm, in any spatial direction.
43. The composition according to one of the preceding points, characterized in that at least 20 wt. %, preferably at least 40 wt. %, more preferably at least 60 wt. % and particularly preferably at least 80 wt. %, of the composition consists of particles in which the ratio of the longest particle diameter determined in any spatial direction to the shortest diameter determined in any spatial direction is between 3:1 and 1:1, preferably between 2.5:1 and 1.2:1 and in particular between 2.2:1 and 1.4:1.
44. The composition according to one of the preceding points, characterized in that at least 20 wt. %, preferably at least 40 wt. %, particularly preferably at least 60 wt. % and more particularly preferably at least 80 wt. %, of the composition consists of particles which have a particle weight of between 2 and 150 mg, preferably between 8 and 120 mg and in particular between 20 and 100 mg.
45. A washing or cleaning agent comprising a solid composition according to one of points 1 to 44.
46. The use of a composition according to one of points 1 to 44, or of an agent according to point 45, as a textile-care agent for fragrancing textile fabrics.
47. The use of a composition according to one of points 1 to 44, or of an agent according to point 45, as a textile-care agent for softening textile fabrics.
48. The use of a composition according to one of points 1 to 44, or of an agent according to point 45, as a textile-care agent for providing textile fabrics with anti-crease properties.
49. A method for treating textiles, in the course of which a composition according to one of points 1 to 44, or an agent according to point 45, is metered into the wash liquor of a textile washing machine.

50. A method for preparing the composition according to one of points 1 to 44, comprising:

a) producing a melt comprising the at least one water-soluble carrier material;

b) metering the fragrance and the textile-care compound into the melt;

c) mixing the melt, the fragrance and the textile-care compound; and d) cooling and optionally reshaping the mixture to obtain perfume-containing melt bodies.

51. A method for preparing the composition according to one of points 1 to 44, comprising:

a) producing, preferably continuously producing and conveying, a melt comprising the at least one water-soluble carrier material;

b) metering the textile-care compound into the melt;

c) subsequently metering in the fragrance;

d) applying drops of the resulting mixture to a cooling belt by means of a drop former having a rotating, perforated outer drum; and e) solidifying the drops of the mixture on the steel belt to form solid melt bodies.

EXAMPLES

The following table contains example formulations of compositions according to the invention (all values in wt. %)

TABLE 1

| | Compositions | | |
|---|---|---|---|
| | V1 | E2 | E3 |
| Sodium acetate (anhydrous) | 54.1% | 53.9% | 53.8% |
| Water | 12.4% | 12.3% | 12.2% |
| Rheology modifier (2% in water) | 24.3% | 24.2% | 24.1% |
| Tris(hydroxymethyl)aminomethane (TRIS) | 2.0% | 2.0% | 2.0% |
| Fragrance | 5.0% | 5.0% | 5.0% |
| Dye | 2.0% | 2.0% | 2.0% |
| Belsil ADM 8301 E | 0.0% | 0.35% | 0.70% |
| Bittern, others | up to 100 | up to 100 | up to 100 |

For the preparation, the sodium acetate was dissolved in water at a temperature of 70° C. with stirring. Subsequently, the other constituents were incorporated. Pastilles were prepared by dropping the liquid mixture ("melt") onto a cooling plate that is temperature-controlled to room temperature (23° C.).

The active ingredient Belsil ADM 8301 brought about a laundry-softening effect after a washing cycle in a household washing machine, which can be demonstrated in a pairwise comparison test using a sensory assessment.

What is claimed is:

1. A solid particulate composition comprising, based on the total weight of the composition, a) 20 to 95 wt. % of at least one water-soluble carrier material selected from hydrous salts of which the water vapor partial pressure corresponds, at a specific temperature in the range from 30 to 100° C., to the $H_2O$ partial pressure of the saturated solution of said salt;

b) 0.1 to 20 wt. % fragrance;

c) 0.1 to 30 wt. % of at least one textile-care compound; and wherein the solid particulate composition comprises melt bodies comprising at least 80 wt % of particles having a spatial extension of between 0.5 and 10 mm in any spatial direction.

2. The composition according to claim 1, wherein the water-soluble carrier material is selected from hydrous salts of which the water vapor partial pressure, at a temperature in the range from 40 to 90° C., corresponds to the $H_2O$ partial pressure of the saturated solution of this salt.

3. The composition according to claim 2, wherein the water vapor partial pressure of the hydrous salts is at a temperature in the range from 50 to 85° C.

4. The composition according to claim 2, wherein the water vapor partial pressure of the hydrous salts is at a temperature in the range from 55 to 80° C.

5. The composition according to claim 2, wherein the hydrous salt is sodium acetate trihydrate ($Na(CH_3COO).3H_2O$).

6. The composition according to claim 1, wherein the water-soluble carrier material is contained in the composition in an amount from 30 to 95 wt. % based on the total weight of said composition.

7. The composition according to claim 6, wherein the water-soluble carrier material is contained in the composition in an amount from 40 to 90 wt. % on the total weight of said composition.

8. The composition according to claim 6, wherein the water-soluble carrier material is contained in the composition in an amount from 45 to 90 wt. % based on the total weight of said composition.

9. The composition according to claim 1, wherein the fragrance is contained in the composition in an amount from 1 to 15 wt. %.

10. The composition according to claim 1, wherein the fragrance comprises perfume oil and fragrance capsules, the weight ratio of perfume oil to fragrance capsules being 30:1 to 1:20.

11. The composition according to claim 1, wherein, based on the total weight thereof, it comprises 0.2 to 20 wt. % textile-care compound.

12. The composition according to claim 1, wherein it comprises a textile-care compound from the group of cationic surfactants.

13. The composition according to claim 1, wherein it comprises a textile-care compound from the group of amphoteric surfactants.

14. The composition according to claim 1, wherein it comprises a textile-care compound from the group of cationic polymers.

15. The composition according to claim 1, wherein it comprises a textile-care compound from the group of fatty substances.

16. The composition according to claim 1, wherein it comprises a textile-care compound from the group of phyllosilicates.

17. The composition according to claim 1, wherein it comprises a textile-care compound from the group of silicones.

18. The composition according to claim 1, wherein it further comprises at least one rheology modifier.

19. The composition according to claim 1, wherein it contains, based on the total weight thereof, 0.1 to 20 wt. % of at least one water-miscible organic solvent.

20. A method for treating textiles, in the course of which a composition according to claim 1 is metered into the wash liquor of a textile washing machine.

* * * * *